US006439792B1

(12) United States Patent
Beguin et al.

(10) Patent No.: US 6,439,792 B1
(45) Date of Patent: Aug. 27, 2002

(54) DEVICE FOR DISPENSING A SEASONING

(75) Inventors: Rémy Beguin; Franz Liebenspacher, both of Winterthur (CH)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/599,218

(22) Filed: Jun. 22, 2000

(30) Foreign Application Priority Data

Jun. 29, 1999 (EP) ..... 99202105

(51) Int. Cl.[7] ..... A47L 13/30

(52) U.S. Cl. ..... 401/261; 401/183; 222/106; 206/484; 206/489

(58) Field of Search ..... 401/183, 184, 401/185, 261, 9; 222/92, 105, 106; 206/484, 489, 497, 216; 53/410, 412, 416, 477, 167

(56) References Cited

U.S. PATENT DOCUMENTS

| | | | | | |
|---|---|---|---|---|---|
| 3,155,282 | A | * | 11/1964 | Leblanc | 206/484 |
| 3,418,059 | A | * | 12/1968 | Robe | 222/106 |
| 4,961,242 | A | * | 10/1990 | Kresse et al. | 15/228 |
| 5,599,126 | A | * | 2/1997 | Hough | 401/184 |
| 5,888,006 | A | * | 3/1999 | Ping et al. | 401/140 |

* cited by examiner

*Primary Examiner*—David J. Walczak
(74) *Attorney, Agent, or Firm*—Winston & Strawn

(57) ABSTRACT

A device for dispensing a liquid, pasty or powdered seasoning, comprising at least one perforation provided in a surface of one end of the device. The perforation being closed off by a removable strip and the surface being extended by a free part cut into juxtaposed tabs forming a fringe.

15 Claims, 1 Drawing Sheet

DEVICE FOR DISPENSING A SEASONING

FIELD OF THE INVENTION

The subject of the present invention is a device for dispensing a seasoning, and a sachet comprising such a device.

BACKGROUND OF THE INVENTION

French patent No. 2,036,261 discloses a sachet made of a heat-sealable plastic containing a liquid, granular or powder product which can be gradually removed in limited amounts. The sachet is able to stand up on one end and has, at an opposite end, one or more perforations in a wall. The perforations are covered with a heat-sealed strip that can be torn off manually.

Canadian patent No. 840,280 discloses a two-faced flexible package for a product to be spread. The package has a flexible reinforcement extending from one end to the other end on one of the faces of the package and an opening for dispensing the product being provided in the other face at one end of the package. The opening is closed off by a tearable adhesive strip. The product can be spread over a surface to be coated by taking the package between one's index finger and thumb in a slightly inclined position and by sliding the open end of the package over the surface to be coated while flexing the reinforcement slightly.

While these devices are somewhat effective, there remains a need for improvements in this area, and the present invention resolves this need.

SUMMARY OF THE INVENTION

The invention is directed to a device for dispensing a seasoning comprising a reservoir defined by at least two surfaces which are joined to form a cavity having an internal volume for receiving a seasoning, the cavity being bound by a perimeter and having at least one end portion; perforations on the end portion of the reservoir cavity; a removable strip for covering the perforations; and a fringe for distributing the seasoning after the strip is removed, the fringe being located adjacent the end portion of the reservoir in position to receive seasoning that exits the cavity through the perforations. This device is particularly effective at dispensing, spreading or coating a liquid or pasty seasoning and is easy to use.

The surfaces of the reservoir are advantageously formed by either connecting at least two sheets or by folding a single sheet in two. The connection is preferably made by heat sealing the free edges of the sheets. Preferably, the removable strip is fixed to the reservoir by an adhesive.

In another embodiment of the invention, the edges of the surfaces are heat sealed along a generally rectangular perimeter and the perforations of the end portion have a diameter of about 0.1 mm to about 3 mm. The sheets that form the surfaces can be made of polypropylene, polyester, polyethylene, a metal foil such as aluminum foil, or any combination thereof, and have a thickness of about 5 $\mu$to about 50$\mu$.

The invention is also directed to a method of making a device for dispensing a liquid or pasty seasoning comprising the steps of: perforating a sheet at regular intervals corresponding to the length of the device; sealing the perforations with a peelable strip; superimposing two sheets, wherein only one sheet has perforations; and longitudinally heating sealing the edges of the two sheets. Subsequently, the two sheets are transversely heat sealed at a distance forming a section having an internal volume such that only one set of perforations is at one transversely sealed end of each section and forming an extension wherein material exceeds for a distance after the transversely sealed end having the perforations. Thereafter, the method comprises the steps of transversely cutting the end not containing the perforations and filling the internal volume with seasoning; heat sealing the transversely cut end; transversely cutting the end containing the perforations; and longitudinally cutting the extension into juxtaposed tabs forming a fringe.

Another embodiment of the method is directed to the making of a device for dispensing a liquid or pasty seasoning by providing a reservoir defined by at least two surfaces which are joined to form a cavity having an internal volume for receiving a seasoning, the cavity being bound by a perimeter and having at least one end portion; forming perforations on the end portion of the reservoir cavity; covering the perforations with a removable strip; and providing a fringe for distributing the seasoning after the strip is removed, the fringe being located adjacent the end portion of the reservoir in position to receive seasoning that exits the cavity through the perforations. The strip is removed to allow the seasoning to exit the cavity through the perforations and to be distributed onto a food by the fringe. Preferably, the reservoir is made of at least one sheet and the fringe is provided by cutting tabs in the sheet.

DETAILED DESCRIPTION OF THE INVENTION

Figure 1:
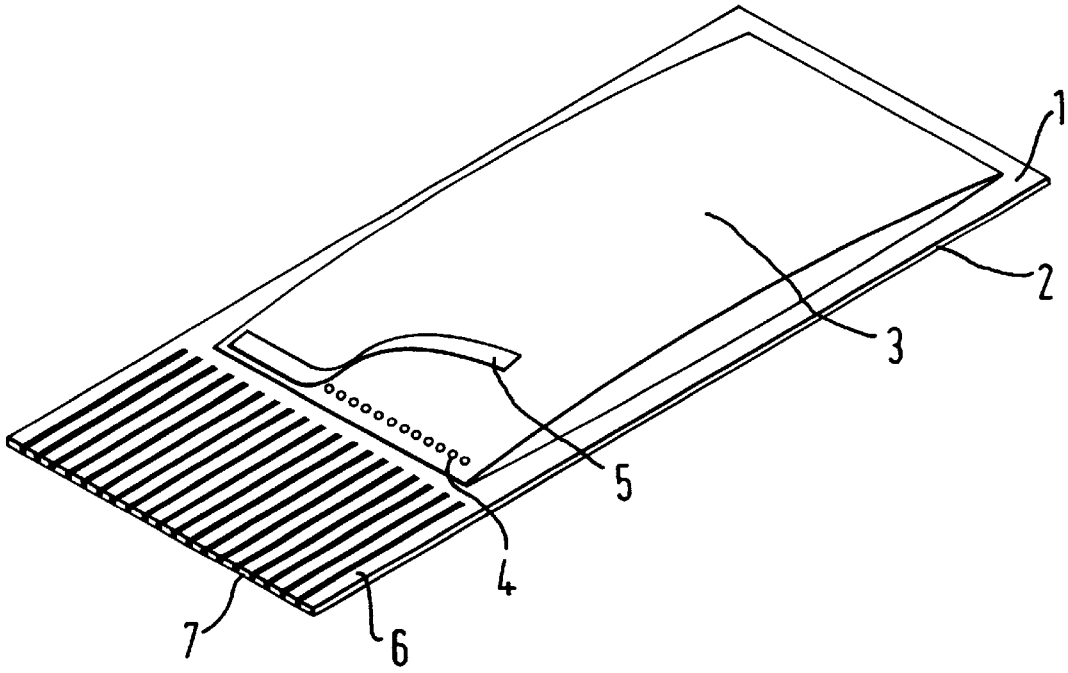
FIG. 1 illustrates a perspective view of a portion reservoir comprising one embodiment of the device of the present invention.

The device for dispensing a seasoning according to the present invention comprises a reservoir having at least one perforation provided along a surface at one end of the reservoir or container. The perforations are sealed by a removable strip, such as a peelable adhesive strip. The device also contains a fringe for distributing the seasoning after the seasoning exits the reservoir through the perforations. The fringe being located adjacent to the reservoir end having the perforations. The fringe can be made by extending at least one surface and cut into juxtaposed tabs forming a fringe. The device can be used to dispense a liquid or pasty seasoning contained in a bottle or a sachet.

The device is simple to manufacture, it being possible for the operations of perforating a wall, especially a wall of an oblong sachet, and of cutting its extension into a series of tabs forming a fringe to follow one another without interruption on the same manufacturing line. The device may be produced in the form of a pouring lip for a bottle or in the form of a dispensing end of a portion sachet.

The device is easy to use. The seasoning flows via the perforation when the strip is removed and the reservoir is held vertically or slightly inclined. The seasoning is able to be dispensed uniformly over a surface to be coated. The seasonings may be in a liquid, fluid paste or powdered form. Once the seasoning exits the reservoir, the seasonings flow over the entire width of the fringe. The flexible tabs of the fringe individually follow the profile of the surface spreading the seasoning.

The device of the present invention is a device for dispensing a seasoning comprising a reservoir with perforations covered by a removable strip and a fringe for distributing the seasoning.

The reservoir is typically defined by at least two surfaces which are joined to form a cavity having an internal volume for receiving a seasoning. The surfaces may have any shape, preferably generally rectangular. The cavity is bound by a perimeter and has at least one end portion. The perforations are on an end portion of the reservoir cavity. The perforations may be one or more perforations aligned along at least one end of the reservoir.

The removable strip covers the perforations. A skilled artisan with little or no experimentation can easily determine a suitable material for the strip. The removable strip may be attached to the reservoir using any adhesive which temporarily maintains the strip attached to the reservoir or by using a material temporarily welded onto the reservoir.

The fringe can be of any shape for distributing the seasoning after the removable strip is removed and the seasoning exits the reservoir. The fringe is located adjacent to the end portion of the reservoir containing the perforations in a position to receive the seasoning as it exits the cavity through the perforations. The fringe can be made by extending at least one surface and cut into juxtaposed tabs forming a fringe.

In a preferred embodiment, the reservoir may be produced by superposition, cutting, heat-sealing and filling of two surfaces. The two surfaces may be at least two sheets or the two sides of a folded sheet. The device may be made of plastic such as polypropylene (PP), polyester (PET), polyethylene (PE), aluminum foil or any combination of these materials. Typically, each sheet has a thickness of about $5\mu$ to about $50\mu$.

In another embodiment, the device is made with two surfaces such as at least two sheets or the two sides of a single sheet which is to be folded or is folded onto itself. The two surfaces may be heat-sealed along a perimeter, preferably a generally rectangular perimeter, and define a cavity with an internal volume. The internal volume can be filled with a liquid, pasty or powdered seasoning. Such seasonings include, but not limited to, a liquid flavoring such as a mayonnaise or mustard.

One of the two surfaces may have one or more round or oval perforations about 0.1 mm to about 3 mm in diameter. The perforations may be aligned in one or more rows of parallel openings at and near one end of the reservoir. The perforations may be covered with a removable strip such as an aluminum peelable strip coated with a suitable adhesive layer.

The fringe may be formed by an extension of one or of the two surfaces beyond the end having the perforations for dispensing the seasoning. The surface or surfaces being cut into juxtaposed tabs extending longitudinally in the extension of the surface or surfaces.

The reservoir may be made in high volume using two sheets running continuously, by means of a process comprising steps of: (a) perforating a sheet at regular intervals corresponding to the total length of the sachet; (b) closing-off of the perforations with a peelable strip; (c) superpositioning two sheets; (c) heat-sealing the longitudinal edges; (d) transverse heat-sealing, below the perforations as well as over a certain length in an extension of the sachet below the perforations; (e) transverse cutting of an upper end: of the sachet; (f) filling via the upper end; (g) heat-sealing of the upper end; (h) transverse cutting of a lower end of the sachet in the extension below the perforations; and (i) longitudinal cutting of the extension into juxtaposed tabs forming a fringe.

In another embodiment of the process, the fringe may be formed in the edge of one of two surface of a continuously running surface, such as a sheet, to be folded. The perforations are provided along one end containing an opposite edge and the manufacturing steps described in greater detail above being able to be suitably adapted.

FIG. 1 illustrates a perspective view of a portion reservoir comprising one embodiment of the dispensing device. The reservoir is formed from two heat-sealed plastic surfaces 1 and 2 defining two walls which between them form an internal volume or container 3 which may contain a liquid, pasty or powdered seasoning.

The dispensing device comprises a row of perforations 4 provided in the surface 1 at one end of the container. The perforations being closed off by a removable strip 5 and the surface being extended by a free part cut into juxtaposed tabs 6 forming a fringe 7. As shown in the drawing, the tabs 6 extend from the reservoir beyond the outlet perforations 4, and the tabs are flexible separately from each other due to the cuts between the tabs 6.

In this embodiment, the tabs are formed by an extension of the two surfaces 1 and 2 adhesively bonded to each other.

What is claimed is:

1. A device for dispensing a seasoning comprising:

a reservoir defined by at least two surfaces which are joined to form a cavity having an internal volume for receiving a seasoning, the cavity being bound by a perimeter and having at least one end portion;

perforations on the end portion of the reservoir cavity;

a removable strip for covering the perforations; and a fringe extending outside the perforations for distributing the seasoning after the strip is removed, the fringe being located adjacent the end portion of the reservoir in position to receive seasoning that exits the perforations.

2. The device according to claim 1, wherein the surfaces are formed by a single folded sheet having a fold line and free edges.

3. The device according to claim 2, wherein at least the free edges of the sheet are heat sealed to form the reservoir.

4. The device according to claim 2, wherein the sheet has a thickness of about $5\mu$ to about $50\mu$.

5. The device according to claim 4, wherein the sheets are heat sealed along their perimeter to form the reservoir.

6. The device according to claim 1, wherein the surfaces of the reservoir are formed from at least two superimposed sheets.

7. A device for dispensing a seasoning, comprising:

a reservoir defined by at least two surfaces which are joined to form a cavity having an internal volume for receiving a seasoning, the cavity being bound by a perimeter and having at least one end portion;

perforations on the end portion of the reservoir cavity;

a removable strip fixed to the reservoir by an adhesive for covering the perforations; and a fringe for distributing the seasoning after the strip is removed, the fringe being located adjacent the end portion of the reservoir in position to receive seasoning that exits the cavity through the perforations.

8. The device according to claim 1, wherein the end portion perforations are about 0.1 mm to about 3 mm in diameter.

9. The device according to claim 1, wherein the reservoir is made of a sheet material and the fringe comprises a series of independent tabs formed in an end of the sheet material and extending outside the perforations, wherein the tabs are flexible separately from each other and are configured for distributing the seasoning.

10. The device of claim 9, wherein the tabs are separated by cuts.

11. The device according to claim 1, wherein the reservoir is made of polypropylene, polyester, polyethylene, aluminum foil or any combination thereof.

12. A method of making a device for dispensing a liquid or pasty seasoning comprising the steps of:

providing a reservoir made of a sheet and defined by at least two surfaces which are joined to form a cavity having an internal volume for receiving a seasoning, the cavity being bound by a perimeter and having at least one end portion;

forming perforations on the end portion of the reservoir cavity;

covering the perforations with a removable strip; and providing a fringe by cutting tabs in the sheet from which the reservoir is made for distributing the seasoning after the strip is removed, the fringe being located adjacent the end portion of the reservoir in position to receive seasoning that exits the cavity through the perforations.

13. The method of claim 12 which further comprises removing the strip to allow the seasoning to exit the cavity through the perforations and to be distributed onto a food by the fringe.

14. A flowable product dispenser, comprising:

a reservoir comprising a cavity with an internal volume for receiving a flowable product, the reservoir having a first end adjacent the tabs;

an outlet associated with the reservoir and defining an opening disposed along the first end for extracting the product from the reservoir;

a fringe disposed adjacent the outlet for receiving the product that exits the outlet, wherein the fringe comprises a plurality of independent tabs extending from the reservoir outside the outlet and that are flexible separately from each other, the tabs being configured for distributing the product; and a removable strip covering and closing the opening.

15. The dispenser of claim 14, wherein die opening comprises a plurality of openings.

* * * * *

UNITED STATES PATENT AND TRADEMARK OFFICE

CERTIFICATE OF CORRECTION

PATENT NO. : 6,439,792 B1
DATED : August 27, 2002
INVENTOR(S) : Begin et al.

It is certified that error appears in the above-identified patent and that said Letters Patent is hereby corrected as shown below:

Title page,
Item [56], References Cited, please add the following U.S. PATENT DOCUMENTS:

| | | | |
|---|---|---|---|
| -- 4,648,506 | 03/1987 | Campbell | 206/216 |
| 4,797,309 | 01/1989 | Kammerer et al. | 428/35.3 |
| 5,111,932 | 05/1992 | Campbell | 206/216 -- |

After the listing of the U.S. PATENT DOCUMENT, please add the following:

-- FOREIGN PATENT DOCUMENTS

| | | |
|---|---|---|
| CA | 840280 | 04/1970 |
| FR | 2 036 261 | 12/1969 |

OTHER PUBLICATIONS
Derwent Abstract of French Patent No. 2 036 261 --

Column 6,
Line 20, change “wherein die opening” to -- wherein the opening --.

Signed and Sealed this

Twelfth Day of November, 2002

*Attest:*

*Attesting Officer*

JAMES E. ROGAN
*Director of the United States Patent and Trademark Office*